United States Patent [19]

Murakami

[11] Patent Number: 4,806,223

[45] Date of Patent: Feb. 21, 1989

[54] ELECTROLYTIC PROCESSING CELL

[75] Inventor: Shinjiro Murakami, Okayama, Japan

[73] Assignee: Kawasaki Steel Corporation, Kobe, Japan

[21] Appl. No.: 124,857

[22] Filed: Nov. 30, 1987

[30] Foreign Application Priority Data

Dec. 2, 1986 [JP] Japan ..... 61-287464

[51] Int. Cl.[4] ..... C25D 17/00

[52] U.S. Cl. ..... 204/206

[58] Field of Search ..... 204/206

[56] References Cited

U.S. PATENT DOCUMENTS 4,378,284 3/1983 Iwasaki et al. ..... 204/206
4,507,190 3/1985 Brendlinger ..... 204/206

FOREIGN PATENT DOCUMENTS 0167868 1/1986 European Pat. Off. .
60-262996 12/1985 Japan .
2067223 7/1981 United Kingdom .

*Primary Examiner*—T. M. Tufariello
*Attorney, Agent, or Firm*—Young & Thompson

[57] ABSTRACT

In an electrolytic processing cell like an electroplating cell comprising a cell body and an electrode, the cell body is formed with an opening, the electrode is removably mounted in the opening by means of a hydraulic jack, and an inflatable sealing member is disposed between the opening and the electrode for releasably providing a seal therebetween.

6 Claims, 8 Drawing Sheets

ELECTROLYTIC PROCESSING CELL

BACKGROUND OF THE INVENTION

This invention relates to an electrolytic processing cell for use in a variety of electrolytic processes including various electroplatings such as zinc electroplating and tin electroplating, electrolytic polishing, and electrolytic cleaning.

A zinc electroplating apparatus is described as one typical example of prior art electrolytic processing apparatus by referring to the accompanying drawings. FIG. 12 is a partially cross-sectional side elevation of a prior art horizontal zinc electroplating apparatus generally designated at 1'. FIG. 13 is a cross section taken along lines XIII—XIII in FIG. 12. The apparatus 1' includes a plating cell 5', support members 40, a pair of upper and lower electrodes 8' and 7' suspended by the support members so as to be disposed in the cell, conducting rolls 19 disposed in the cell for guiding and transferring a strip 37 to be plated across the electrodes and through the cell and for conducting electricity to the strip, a pair of nozzles 18 for supplying plating solution toward the strip between the electrodes, and conductors 39 electrically connected to the electrodes for conducting electricity to the electrodes. Zinc electroplating is carried out by passing the strip 37 between the upper and lower electrodes 8' and 7', injecting plating solution from the nozzles 18 toward the strip 37 between the electrodes, and conducting electricity across the strip 37 and the electrodes 8', 7' through the rolls 19 and the conductors 39.

The zinc electroplating apparatus 1' illustrated is designed such that the electrodes 8', 7' are suspended by the support members 40 from outside the cell 5'. Then the conductors 39, 39 for supplying electricity to the electrodes 8', 7' must be extended from outside the cell 5' along the suspending members 40 until they are connected to edge portions of the electrodes 8', 7'. Undesirably, longer the conductors, the more is the electric resistance and hence, the power loss.

The prior art zinc electroplating apparatus 1' illustrated in FIGS. 12 and 13 encounters another problem in replacing the electrodes 8', 7'. Because of the construction illustrated, the strip 37 in the cell 5' must be cut before the lower electrode 7' can be removed from the cell for replacement. A relatively long time is required for such replacement, that is, the down time in which the continuous plating or processing line is interrupted is long enough to lower productivity.

Another example is illustrated in FIGS. 14 and 15. FIG. 14 is a partially cross-sectional side elevation of a prior art vertical zinc electroplating apparatus generally designated at 3'. FIG. 15 is a cross section taken along lines XV—XV in FIG. 14. The apparatus includes cell segments 20' separated by vertical partitions, conducting rolls 27, dip rolls 33 disposed in the cell segments, and vertically extending electrodes 38 spaced apart from each other in a horizontal direction. A strip 37 is passed through the cell while it is alternately trained around the conductor rolls 27 and the dip rolls 33. The vertical zinc electroplating apparatus 3' also encounters a problem in replacing those electrodes 38 located adjacent the cell partitions. The conducting rolls 27 must be removed and the strip 37 must be cut before the electrodes 38 can be removed from the cell 20'. The plating line is interrupted for a relatively long time for such replacement, resulting in a loss of productivity.

Electricity is usually supplied to the electrodes 38 by connecting conductors 41 to support members 42 from which the electrodes 38 are suspended. Then the internal resistance of the support members 42 increases the overall power loss. Even when the conductors 41 are directly connected to the electrodes 38, the length of the conductors 41 must be increased as in the horizontal zinc electroplating apparatus illustrated above, also resulting in an increased power loss.

An improved electroplating apparatus is proposed in Japanese Patent Application Kokai No. 58-7000 in which electrodes can be replaced without cutting a strip in a plating cell. The apparatus, however, employs a rather complicated structural design for electrode replacement, and the replacing operation is cumbersome. The apparatus has not eliminated the drawback of an increased power loss because long conductors are still required for electricity supply.

SUMMARY OF THE INVENTION

Therefore, an object of the present invention is to provide a new and improved electrolytic processing cell which has eliminated the above-mentioned drawbacks of the prior art cells, uses a minimum length of conductor for supplying electricity to electrodes to thereby lower the power loss, and allows for easy and quick electrode replacement.

To achieve such an object, electrodes and conductors for supplying electricity thereto of an electrolytic processing cell must satisfy the requirements that (1) the electrodes can be removably mounted from outside the electrolytic processing cell, and (2) conductors can be connected to the rear side of the electrodes.

Our investigations on the structure of an electrolytic processing cell capable of satisfying requirements (1) and (2) have led to the following findings.

(a) If an electrolytic processing cell body is formed with an opening having a shape corresponding to that of an electrode, then the electrode can be mounted in the opening or removed from the opening from outside the cell.

(b) If the rear side of the electrode fitted in the opening is exposed or accessible outside the cell, then the electrode rear side can be directly connected to a conductor.

(c) If the gap between the electrode and the opening is releasably sealed, then the electrode can be readily replaced. Required is sealing means that seals the gap when the electrode is fitted in the opening or during operation of the electrolytic processing cell, to thereby prevent processing solution in the cell from leaking through the gap. The sealing means must also release a seal when the electrode is removed from the opening and replaced by a new electrode, to thereby facilitate electrode replacement.

The present invention is predicated on these findings and provides an electrolytic processing cell comprising a configured electrode, a cell body having at least one opening configured to mate with the configuration of the electrode, the cell body being charged with an electrolyte, support means for supporting and mounting said electrode in the opening, and seal means disposed between the opening and said electrode for releasably sealing the gap therebetween.

Preferably, the seal means comprises a tubular sealing member which is expandable and contractable under the influence of its internal pressure. The support means removably secures said electrode in the opening in the body. The electrolytic processing cell of the invention may be considered as a part of an electrolytic processing apparatus.

BRIEF DESCRIPTION OF THE DRAWINGS

The above and other objects, features, and advantages of the present invention will be better understood by reading the following description taken in conjunction with the accompanying drawings, in which.

DETAILED DESCRIPTION OF THE INVENTION

The electrolytic processing cell of the present invention may be used in a variety of electrolytic processes including electroplating, electrolytic polishing and electrolytic cleaning.

The present invention is independent of the type of electrolytic processing cell, that is, applicable to any types of electrolytic processing cell including horizontal, vertical and radial types. The following description is made to horizontal, vertical and radial electrolytic processing cells as typical cells to which the present invention is applied.

Figure 1:
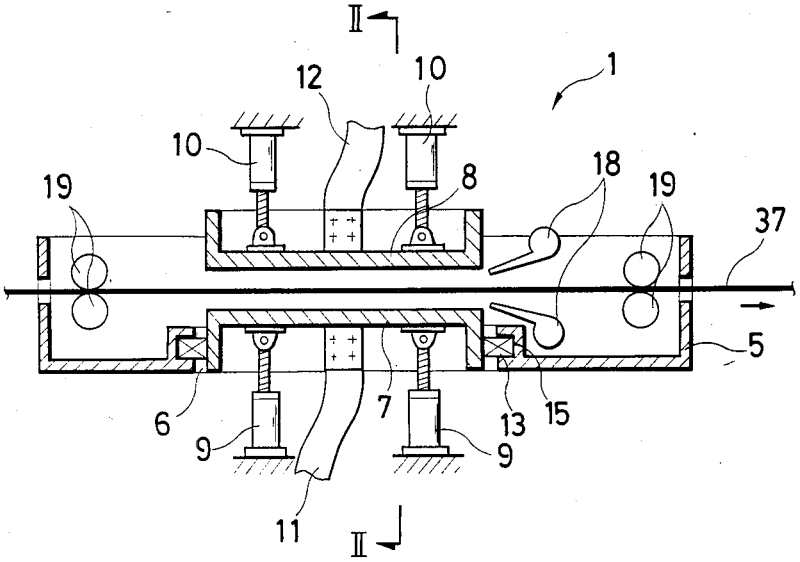
FIG. 1 is a side-elevational cross section of a horizontal electrolytic processing cell according to one embodiment of the present invention.
Figure 2:
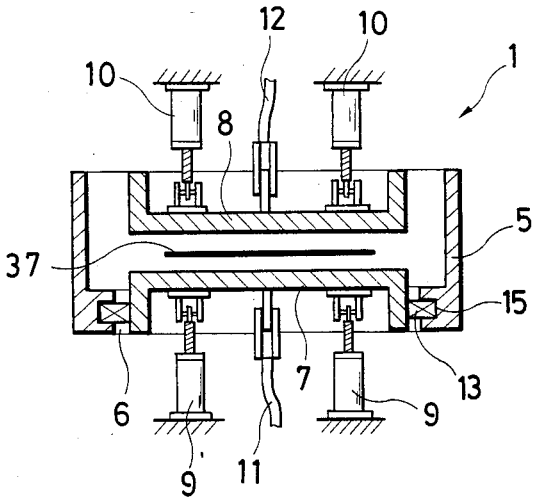
FIG. 2 is a cross section taken along line II—II in FIG. 1.

FIG. 1 is a side-elevational cross section of a horizontal electrolytic processing cell according to one embodiment of the present invention, and FIG. 2 is a cross section taken along line II—II in FIG. 1. The electrolytic processing cell designated at 1 includes a cell body 5 of a generally rectangular cross section having bottom and side walls and open at the top in the illustrated embodiment. The bottom wall of the cell body 5 is formed with an opening 6 which is configured to mate with the configuration of a lower electrode 7. The lower electrode 7 is fitted in the mating opening 6 in the cell bottom wall. The major surface of the electrode extends horizontally and is in contact with electrolyte filling the cell. A strip 37 is passed horizontally through the cell. Sealing means in the form of a sealing member 13 which will be described later is disposed in the gap between the edge of the opening 6 and the periphery of the electrode 7 to prevent electrolytic solution in the cell from leaking therethrough.

The electrode 7 is supported and secured in place by support means 9. The support means 9 is means for removably supporting the electrode, that allows the electrode 7 to be moved in a direction perpendicular to the strip transfer direction so that the electrode 7 may be removed from or mounted in the opening 6, and the distance between the electrode 7 and the strip 37 may be adjusted. To this end, the support means 9 may be comprised of a hydraulic cylinder or jack. The electrode 7 may be mounted in or removed from the opening 6 and the distance between the electrode 7 and the strip 37 may be adjusted by properly actuating the support means 9.

In the embodiment illustrated in FIGS. 1 and 2, the electrode 7 is formed of a flanged rectangular plate and constitutes a portion of the electrolytic processing cell body 5 with its rear or lower surface exposed outside the cell. Then a conductor 11 may be connected to the rear surface of the electrode 7 for supplying electricity thereto, resulting in a reduction of electric resistance.

A similar structure is employed on the upper side of the electrolytic processing cell 1. An upper electrode 8 is suspended and supported by support means 10 similar to the above-mentioned support means 9. The active or lower surface of the upper electrode 8 extends substantially parallel to that of the electrode 7. To the rear or upper surface of the electrode 8 is connected a similar conductor 12 for supplying electricity thereto.

In the horizontal electrolytic processing cell 1 of the above-mentioned construction, the strip 37 is continuously passed between the lower and upper electrodes 7 and 8 with the aid of conducting rolls 19 in a direction shown by an arrow. Electrolytic processing or plating of the strip 37 is carried out while electrolytic solution or plating solution is injected from a pair of nozzles 18 toward the strip between the electrodes 7 and 8 to fill the space with the solution and electricity is conducted across the electrodes 7, 8 and the strip 37 through the conductors 11, 12 and the conducting rolls 19.

The sealing means in the form of sealing member 13 disposed between the edge of the opening 6 and the periphery of the electrode 7 will be described in detail. The sealing member 13 should be of such a structure that when the electrode 7 is fitted in the opening 6 or during operation of the electrolytic processing cell, the sealing member provides a seal between the opening edge and the electrode periphery to prevent the processing solution in the cell from leaking therethough, and that when the electrode 7 is removed from the opening 6 and replaced by a new electrode, the seal is released so as to facilitate removal and replacement of the electrode. A typical and preferred example of the sealing means that satisfy the above requirement is a tubular seal member 13 known as an inflatable seal, but not limited thereto. As the other types of sealing means a ring member such as a O-ring or a U-ring can be used in the present invention.

Figure 8A:
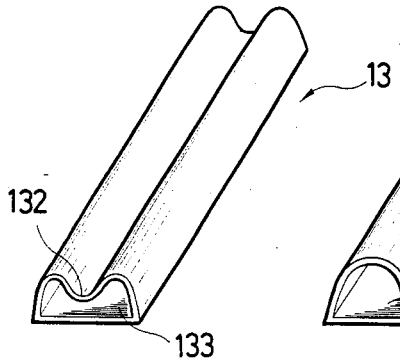
FIG. 8*a* and 8*b* are perspective views showing a part of a sealing member used in the present invention in released and inflated states.
Figure 8B:
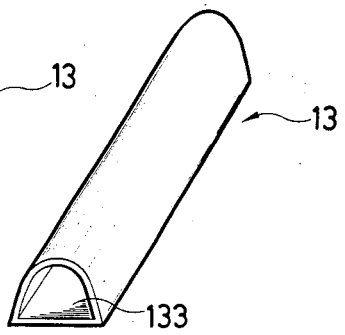
Figure 9A:
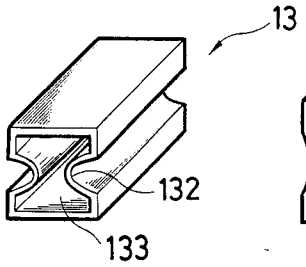
FIG. 9*a* and 9*b* are perspective views showing a part of another sealing member used in the present invention in released and inflated states.
Figure 9B:
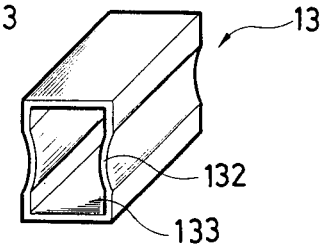
Figure 10:
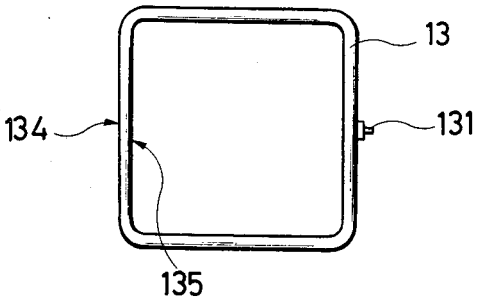
FIG. 10 is a plan view showing the entire structure of the sealing member used in the present invention.

Some exemplary structures of the inflatable seal are shown in FIGS. 8*a*, 8*b*, 9*a*, 9*b*, and 10. As shown in these figures, the inflatable seal 13 is a tubular seal member of a special cross-sectional shape having an internal gas chamber 133 defined therein. The tubular seal member 13 as a whole is a doughnut-shaped hollow tube having a plug 131 as shown in FIG. 10. The inflatable seal 13 is made of a resilient material such as rubber or synthetic resin and is deformable under the influence of the gas pressure within the internal gas chamber 133.

More specifically, the inflatable seal 13 shown in FIGS. 8*a* and 8*b* includes a deformable portion 132 attached to a relatively rigid portion to define an annular space 133. The deformable portion 132 presents a recessed shape in normal or non-inflated condition as shown in FIG. 8*a*. The deformable portion 132 is expanded to provide a convex shape as shown in FIG. 8*b* when gas is forcedly injected into the chamber 133 through the plug 131 to increase the internal pressure.

Another example of the inflatable seal 13 is shown in FIGS. 9*a* and 9*b*. The seal of this example includes a pair of deformable portions 132 attached to a pair of relatively rigid inner and outer portions to define an annular space 133. The deformable portions 132 present a recessed shape in normal or non-inflated condition as shown in FIG. 9*a*. More specifically, the contracted portions 132 each are of a curved shape convex with respect to the inside having a small radius of curvature. The deformable portions 132 are expanded and stretched to provide a flattened shape as shown in FIG. 9*b* when gas is forcedly injected into the chamber 133 through the plug 131 to increase the internal pressure. More specifically, the flattened portions 132 each are of a curved shape convex with respect to the inside having a large radius of curvature. As a result, the distance between the inner and outer portions is increased.

The inflatable seal 13 is expanded and contracted in this manner by controlling the internal pressure of gas in the internal chamber 133. The cross-sectional shape of the inflatable seal 13 is not limited to those shown in FIGS. 8 and 9 as long as it can be expanded and contracted under the influence of its internal pressure.

Figure 11A:
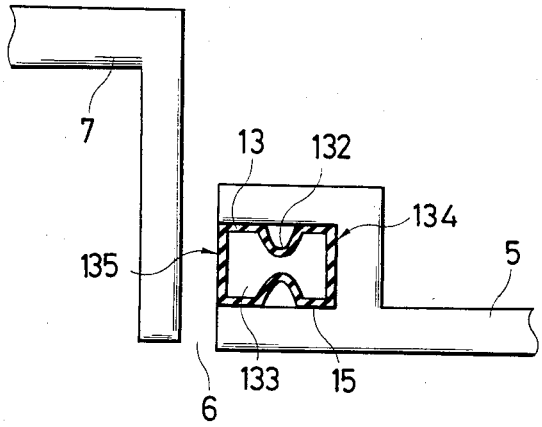
FIGS. 11*a* and 11*b* are cross-sectional views of the sealing member fitted between the associated portions in released and inflated (operating) states.
Figure 11B:
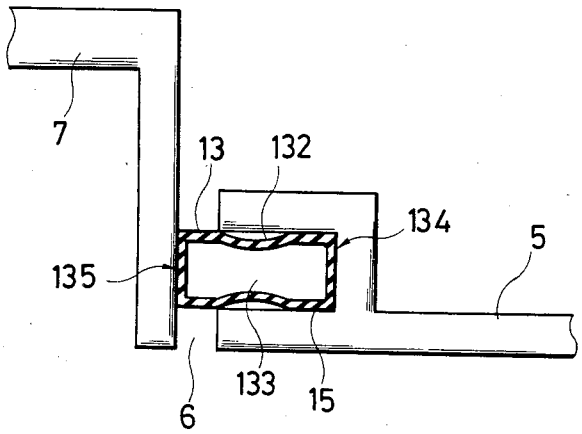
Figure 12:
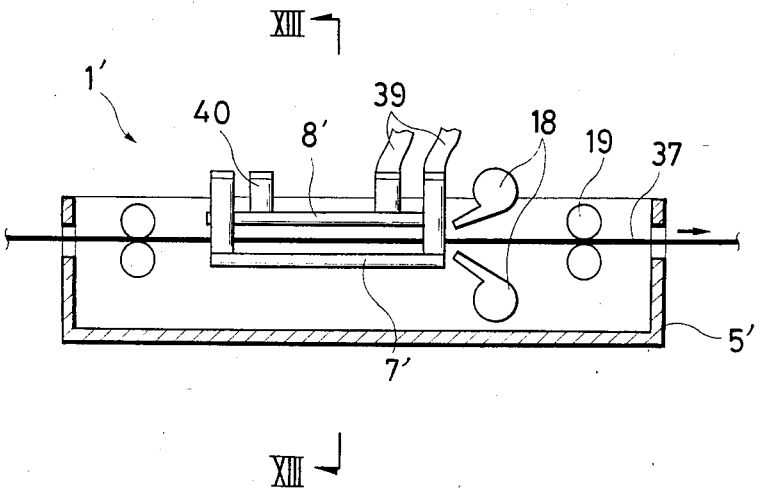
FIG. 12 PRIOR ART
FIG. 12 is a side-elevational cross section of a prior art horizontal zinc electroplating cell.
Figure 13:
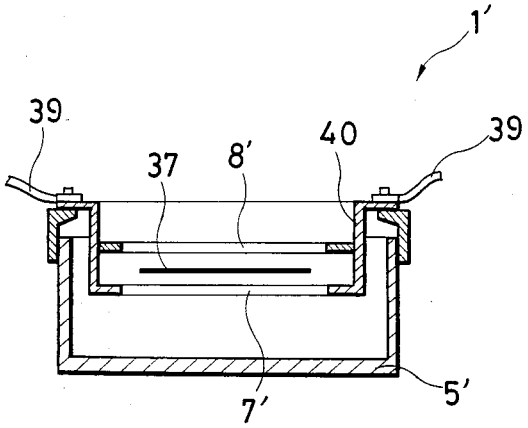
FIG. 13 PRIOR ART
FIG. 13 is a cross section taken along line XIII—XIII in FIG. 12.
Figure 14:
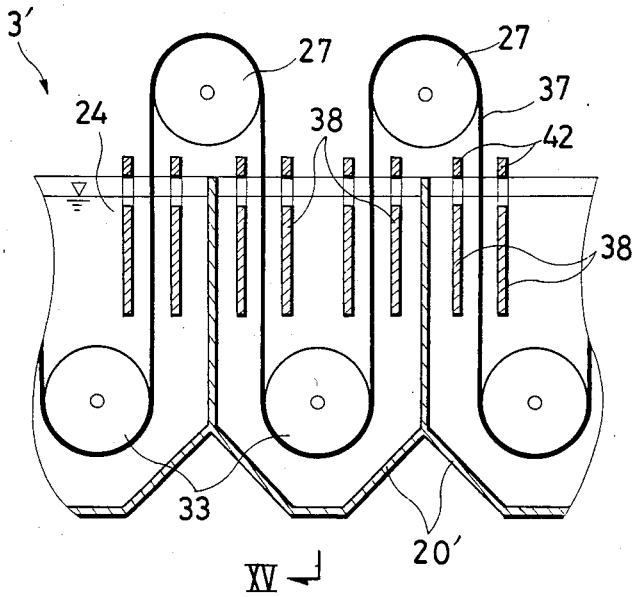
FIG. 14 PRIOR ART
FIG. 14 is a side-elevational cross section of a prior art vertical zinc electroplating cell.
Figure 15:
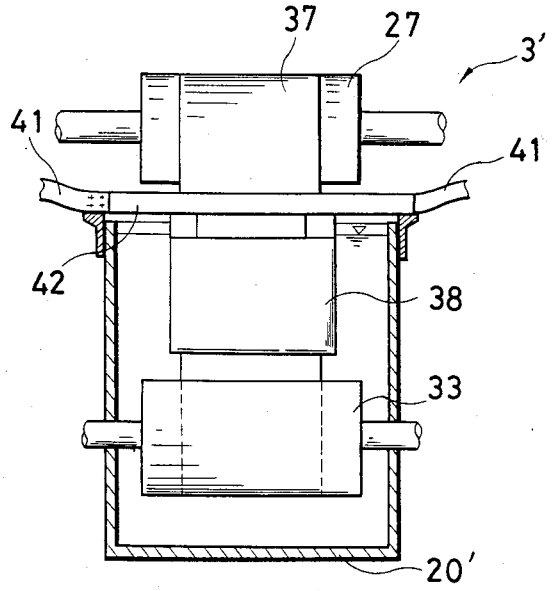
FIG. 15 PRIOR ART
FIG. 15 is a cross section taken along line XV—XV in FIG. 14.

FIGS. 11*a* and 11*b* illustrate how the inflatable seal functions with associated members. In the illustrated example, the inflatable seal member shown in FIGS. 9*a* and 9*b* is applied to the electrolytic processing cell. That portion of the cell body 5 delineating the opening 6 is formed with a channel 15. The inflatable seal member 13 is received in the channel 15. An outer wall 134 of the seal member 13 is secured to the bottom of the channel 15, for example, by bonding. An innner wall 135 is opposed to the peripheral side of the electrode 7, but kept free.

When gas is forced into the internal chamber 133 through the plug 131 (FIG. 10) to increase the internal pressure, the inflatable seal member 13 is expanded or stretched as shown in FIG. 11*b* so that the inner wall 135 is brought in close contact with the opposing periphery of the electrode 7 to complete a seal against processing solution in the cell.

Although the channel 15 for receiving the inflatable seal member 13 therein is formed in the electrolytic processing cell body 5 in the illustrated embodiment, the present invention is not limited thereto. The inflatable seal member 13 may be received in a channel formed in the periphery of the electrode. Such structures may also be used in combination.

Figure 3:
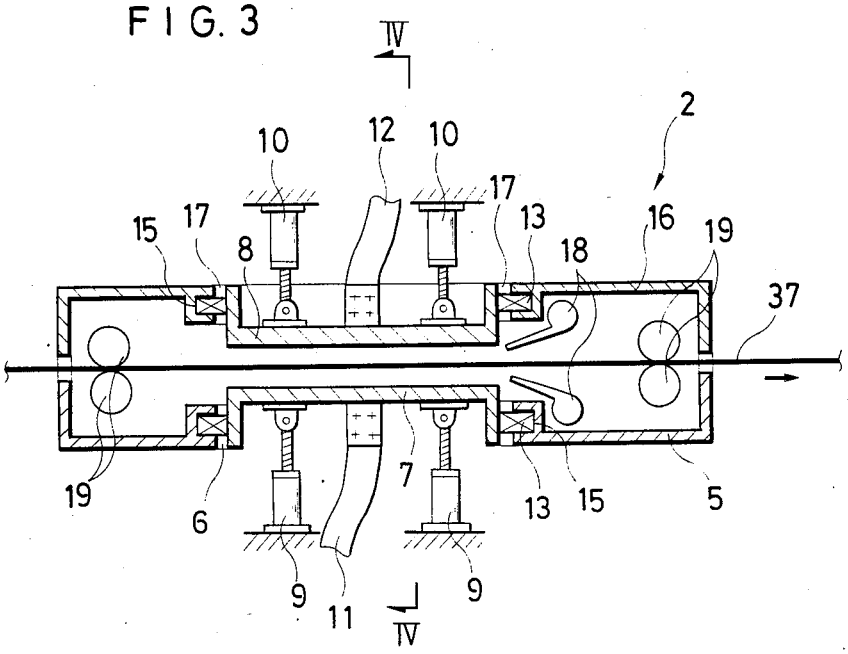
FIG. 3 is a side-elevational cross section of a horizontal electrolytic processing cell according to another embodiment of the present invention.
Figure 4:
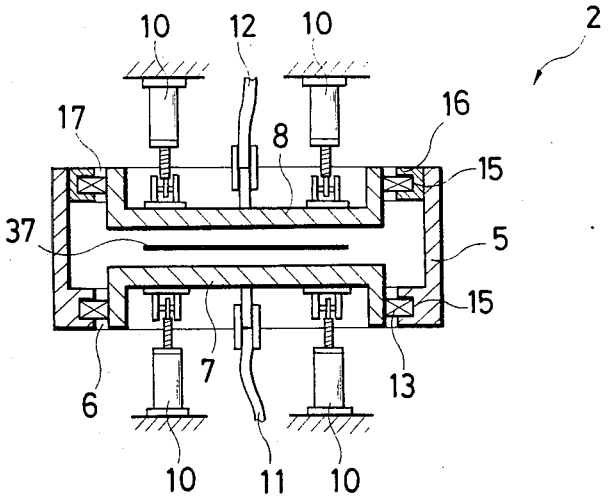
FIG. 4 is a cross section taken along line IV—IV in FIG. 3.

The horizontal electrolytic processing cell 1 illustrated in FIGS. 1 and 2 has an open top. A closed top cell is also contemplated herein. FIGS. 3 and 4 illustrate a closed horizontal electrolytic processing cell 2. The lower side of the cell is the same as in the first embodiment. The upper side of the cell is closed with a cover 16 for the purpose of preventing splashing of processing solution. The top cover 16 is formed with an opening 17 which is similar to the opening 6 in the bottom of the cell body 5. An upper electrode 8 is fitted in the opening 17. Also in this closed cell 2, it is preferred to provide a releasable seal between the edge of the opening 17 and the periphery of the upper electrode 8. To this end, another seal member or inflatable seal member 13 may be received in a channel 15 formed in the top cover 16 or upper electrode 8. Then the seal around the periphery of the upper electrode 8 may be established or released by expanding or contracting the inflatable seal member 13.

A further embodiment will be described in which the present invention is applied to a vertical electrolytic processing cell.

Figure 5:
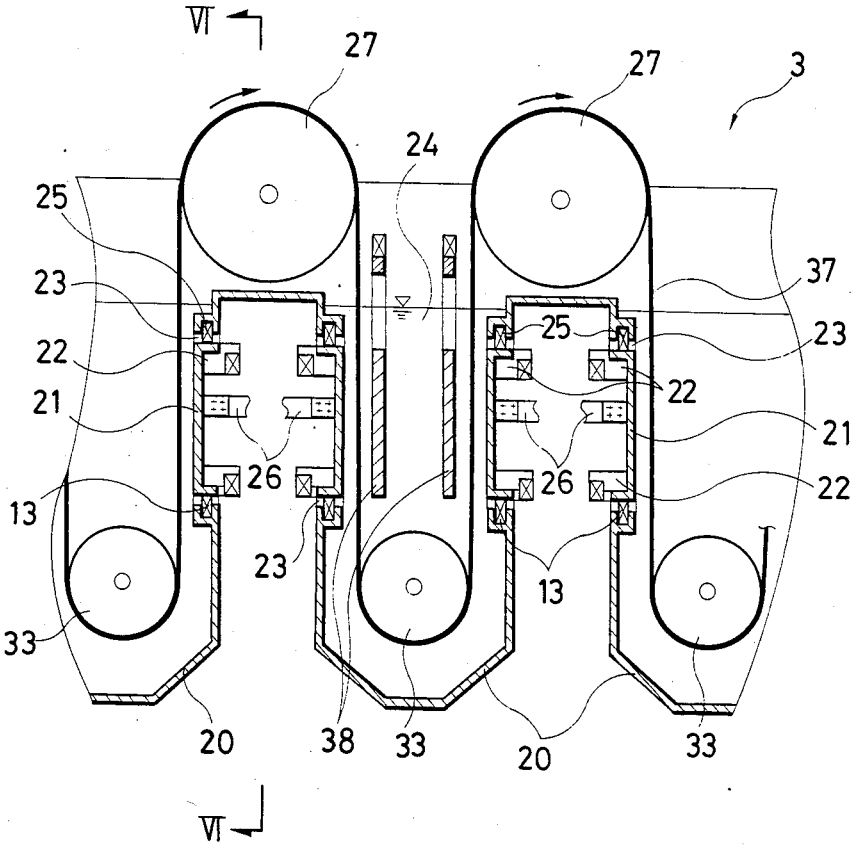
FIG. 5 is a side-elevational cross section of a vertical electrolytic processing cell according to the present invention.
Figure 6:
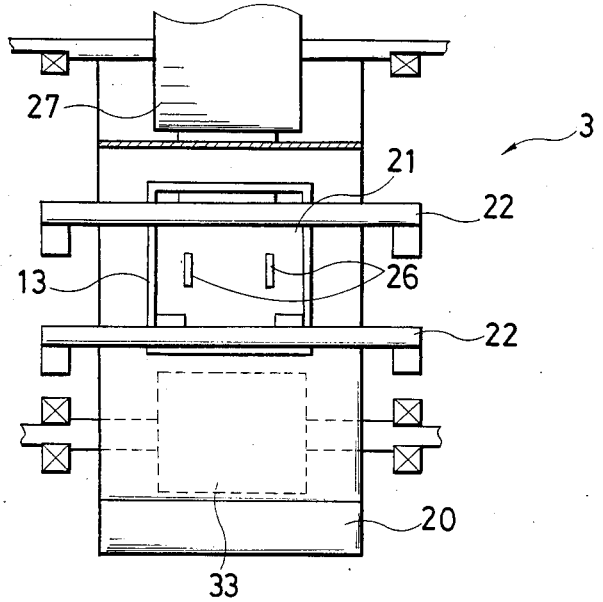
FIG. 6 is a cross section taken along line VI—VI in FIG. 5.

FIG. 5 is an elevational cross section of a vertical electrolytic processing cell designated at 3 and FIG. 6 is a cross section taken along lines VI—VI in FIG. 5. The cell 3 has a plurality of spaced-apart cell segments. Each cell segment includes a tank-shaped body 20 for containing electrolyte 24 therein, vertically extending electrodes 21 and 38, a conducting roll 27 disposed above and between the adjoining cell segments, and a dip roll 33 disposed in the body. The side wall of the cell body 20 is formed with an opening 23 of a configuration corresponding to that of the electrode 21. The electrode 21 is fitted in the opening 23. An inflatable seal member 13 of the same design as previously described is disposed between the edge of the opening 23 and the periphery of the electrode 21 to prevent leakage of electrolyte 24 in the cell. More specifically, the inflatable seal member 13 is received in a channel 25 in the cell body 20 (or electrode 21) and expanded or contracted in the manner previously described in conjunction with FIGS. 11*a* and 11*b*, thereby completing or releasing a seal around the electrode 21. The electrodes 21 are supported by adjustable support bars 22. The distance between the electrodes 21 and the strip 37 may be controlled by adjusting the position of the support bars 22.

The rear side of each electrode 21 which is remote from its surface in contact with the electrolyte is connected to a conductor 26 for supplying electricity thereto, resulting in a minimized electric resistance.

In the vertical electrolytic processing cell 3 illustrated, the strip 37 is continuously transferred through the cell segments by turning around the conducting roll 27 located above the cell and rotating in a direction shown by an arrow, entering the electrolyte or plating solution 24 in the cell, passing downward between the electrode 38 suspended in the solution and the electrode 21 fitted in the partition wall opening, turning over the dip roll 33 located at the bottom of the cell segment, passing upward between another pair of electrodes 38 and 21, emerging from the solution, and turning around the subsequent conducting roll 27. The strip 37 is electrolytically processed, for example, electroplated by conducting electricity across the conducting rolls 27 and the electrodes 21, 38.

A still further embodiment will be described in which the present invention is applied to a radial electrolytic processing cell.

Figure 7:
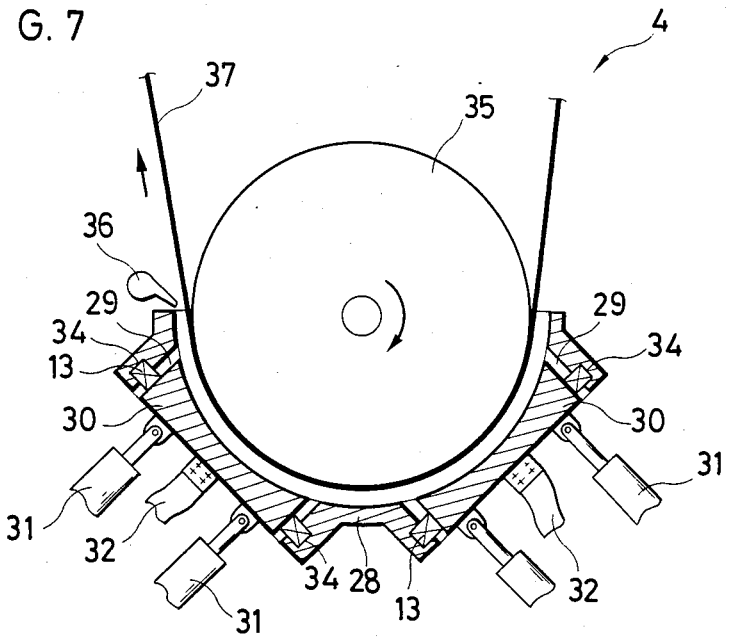
FIG. 7 is a side-elevational cross section of a radial electrolytic processing cell according to the present invention.

FIG. 7 is an elevational cross section of a radial electrolytic processing cell 4. The cell 4 includes a cell body 28 defining an inside surface having a semi-circular cross section and a winding cylindrical roll 35 received in the semi-circular inside cavity of the body with a suitable spacing. The body 28 is provided with a pair of openings 29 each configured so as to mate with the configuration of an electrode 30. The electrode 30 is fitted in the opening 29. The electrode 30 also defines an arch inside surface. That is, the remaining portions of the body 28 and the electrodes 30 form a substantially continuous semi-circular inside surface in conformity with the roll 35. As a strip 37 is turned around the roll 35 which rotates in a direction shown by an arrow, the strip 37 is passed from the upper right to the upper left via the roll 35 in FIG. 7. The space defined between the cell body 28 and the roll 35 is filled with an electrolyte or plating solution. The solution is fed by a nozzle 36 which is preferably located at the downstream end of the cell body so as to inject the solution in a counter flow relationship with respect to the movement of the strip 37.

Disposed between the edge of the opening 29 and the periphery of the electrode 30 is a sealing member or inflatable seal member 13 of the same structure as previously illustrated. The sealing member 13 prevents the electrolyte in the cell from leaking through the gap between the opening 29 and the electrode 30.

More specifically, the inflatable seal member 13 is received in a channel 34 formed in the cell body 28 (or the electrode 30). It is expanded or contracted in the same manner as described in conjunction with FIGS. 11*a* and 11*b* to thereby complete or cancel a seal around the periphery of the electrode 30. Each electrode 30 is held by support means 31, preferably in the form of a hydraulic cylinder or jack. Thus the electrode 30 may be mounted in or withdrawn from the opening 29 and moved toward and away from the strip 37 by properly actuating the support means 31.

A conductor 32 is connected to the rear side of each electrode 30 to supply electricity thereto with minimum electric resistance.

In the radial electrolytic processing cell 4 illustrated, the strip 37 is continuously passed through the cell by winding around the roll 35 rotating in the arrowed direction, passing through the electrolyte while being opposed to the electrodes 30, and then moving out of the cell. One side of the strip 37 undergoes electrolytic treatment, for example, electroplating while the electrolyte or plating solution is fed in between the strip 37 and the electrode 30 from the nozzle 36, preferably in a counter-flow manner, and electric current is supplied across the roll 35 and the electrodes 30.

In the electrolytic processing cell according to the present invention, a cell body is formed with an opening, an electrode is fitted in the opening, and releasable sealing means is provided between the opening and the electrode such that it may establish a seal therebetween when the electrode is fitted in the opening or during operation of the cell and it may cancel a seal when the electrode is removed from the opening and replaced by a new electrode. Upon electrode replacement, the consumed electrode may be easily withdrawn and a new electrode mounted from outside the cell without cutting of the strip or removal of the conducting roll. Then the time required for electrode replacement, that is, the down time when the continuous processing line is interrupted is reduced, contributing to an improvement in productivity.

Since the rear side of the removable electrode is exposed outside the electrolytic processing cell of the present invention, a lead for conducting electricity may be directly connected to the rear side of the electrode, contributing to a reduction of electric resistance, and hence a reduction of power consumption loss.

I claim:

1. In an electrolytic processing cell comprising
a configured electrode,
a cell body having at least one opening configured to mate with the configuration of the electrode, the cell body being charged with an electrolyte,
said electrode being movable into said opening in one direction,
supporting means for supporting and mounting said electrode in the opening, and
seal means disposed between the opening and said electrode for releasably sealing the gap therebetween;
the improvement in which said seal means comprises a tubular sealing member which is expandable and contractible under the influence of its internal pressure and in which there are marginal surfaces on said electrode and on said cell body surrounding said opening, one of said marginal surfaces extending in said one direction and the other of said marginal surfaces carrying said tubular sealing member in a position to seal against said one marginal surface.

2. An electrolytic processing cell according to claim 1 which further comprises a conductor connected to the surface of the electrode remote from its surface in contact with the electrolyte.

3. An electrolytic processing cell according to claim 1 which is of horizontal type.

4. An electrolytic processing cell according to claim 1 which is of vertical type.

5. An electrolytic processing cell according to claim 1 which is of radial type.

6. An electrolytic processing cell according to claim 1, wherein said one marginal surface is on said electrode.

* * * * *